US005329680A

United States Patent [19]

Manne

[11] Patent Number: 5,329,680

[45] Date of Patent: Jul. 19, 1994

[54] PROCESS FOR MANUFACTURING FELTED PRODUCTS

[75] Inventor: Liora G. Manne, New York, N.Y.

[73] Assignee: M G K Group Inc., New York, N.Y.

[21] Appl. No.: 924,163

[22] Filed: Aug. 3, 1992

[51] Int. Cl.[5] ..... D04H 1/20

[52] U.S. Cl. ..... 28/107; 28/109; 28/163

[58] Field of Search ..... 28/107, 109, 112, 163, 28/117; 26/69 R; 428/284, 299, 282, 300

[56] References Cited

U.S. PATENT DOCUMENTS

| | | | |
|---|---|---|---|
| 2,132,530 | 10/1938 | Greiser | 28/109 |
| 3,845,529 | 11/1974 | Van Deusen et al. | 28/109 |
| 4,144,366 | 3/1979 | Lewis | 28/109 |
| 4,172,170 | 10/1979 | Foye | 28/107 |
| 4,211,593 | 7/1980 | Lochner | 28/109 |
| 4,287,246 | 9/1981 | Thornton et al. | 28/107 |
| 5,003,674 | 4/1991 | Cohen et al. | 28/109 |
| 5,144,730 | 9/1992 | Dilo | 28/109 |

FOREIGN PATENT DOCUMENTS

| | | | |
|---|---|---|---|
| 17322 | 4/1934 | Australia | 28/109 |
| 64743 | 10/1982 | Israel . | |

*Primary Examiner*—Clifford D. Crowder
*Assistant Examiner*—Amy B. Vanatta
*Attorney, Agent, or Firm*—Francis J. Bouda

[57] ABSTRACT

In the process of the present invention, a plurality of synthetic or natural fibers are arranged by type and color and then lightly needle-punched to form a felted section. One or more of these sections can be cut to appropriate shapes and sizes and then lightly tacked to the base carrier. Thereafter the sections are needle-punched with said base to interlock the fibers, base and carrier.

8 Claims, 2 Drawing Sheets

PROCESS FOR MANUFACTURING FELTED PRODUCTS

The present invention is directed to a process for individualized, personalized, artistic reproductions of artwork on textiles or fabric materials such as carpets, rugs, wall coverings and the like.

It basically uses a laminar method for applying layers of synthetic and/or natural fibers and assembling them in a unique montage, image or pattern.

This invention not only relates to and is an improvement over the invention shown in U.S. Pat. No. 5,033,674 dated Apr. 2, 1991 (of which Applicant is a co-inventor), but is furthermore an improvement over the references cited in that patent, particularly Israeli Patent 64743 of October, 1982, of which Applicant's co-inventor in U.S. Pat. No. 5,033,674 is a co-inventor.

The process enables a person skilled in the needle-punching textile field to begin with a work of art, which may be a mosaic taken from an ancient Roman or Greek floor, or a modernistic art piece similar to those hanging in the National Museum of Art, and to work with the artists, designers and decorators to produce rugs, tapestry, textiles, handbags, clothing, placemats, and the like, out of these synthetic and/or natural fibers.

It can even be extended to the artwork of clothing designers to develop in this unique material the patterns suitable for garments, handbags, hats, coats, etc.

Even more interesting is the fact that it is possible to create 3-dimensional impressions such as trompe l'oeil mosaic rugs with hundreds of small felt squares which create an illusionistic, 3-dimensional surface.

The process which involves entangling layers of felt allows textile designers to use different colors of felt which they can build up like paint on a canvas. The pieces of felt are cut and shaped and constructed in designs for rugs that are laminated for durability.

It is even possible to reproduce fake animal skins, such as leopard, tiger and zebra, or mosaic rugs and the like, all constructed with individual fragments of layered, felted fiber.

With the present invention, it is possible to emulate not just shades, but the texture of mosaics and other materials reproduced in the needle-felted, laminated, layered assembly of the present invention. These patterns can be extended to include the appearance of tile, wood, stone, or other subjects derived from nature or antiquity.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings wherein like reference characters indicate like parts:

In the process of the present invention, a base material of a pre-dyed wool or rayon nonwoven material, of selected color, provides a clean strong backing for the final product.

Thereafter, a lightly-needled-punched acrylic material 11 with a polyester scrim is laid upon the base. This provides thickness to the final product as well as adding a dimensional stability, because it minimizes shrinkage or other distortion.

The third step in the process is the preparation of the desired actual design 12. In most designs (especially mosaics, tiles, stone or wood), separate sections 13 are first created separately and may consist of 10 or more varieties of colored fibers. Each section is designed with a colored webbing as the base and up to 10 or more colored fibers are pulled or teased very lightly and layered on top of each other in a manner calculated to give the desired effect. At this stage, the sections 13 can be lightly needled and may be very lightweight and brittle, particularly if some short staple acrylic fibers are used.

Figure 1:
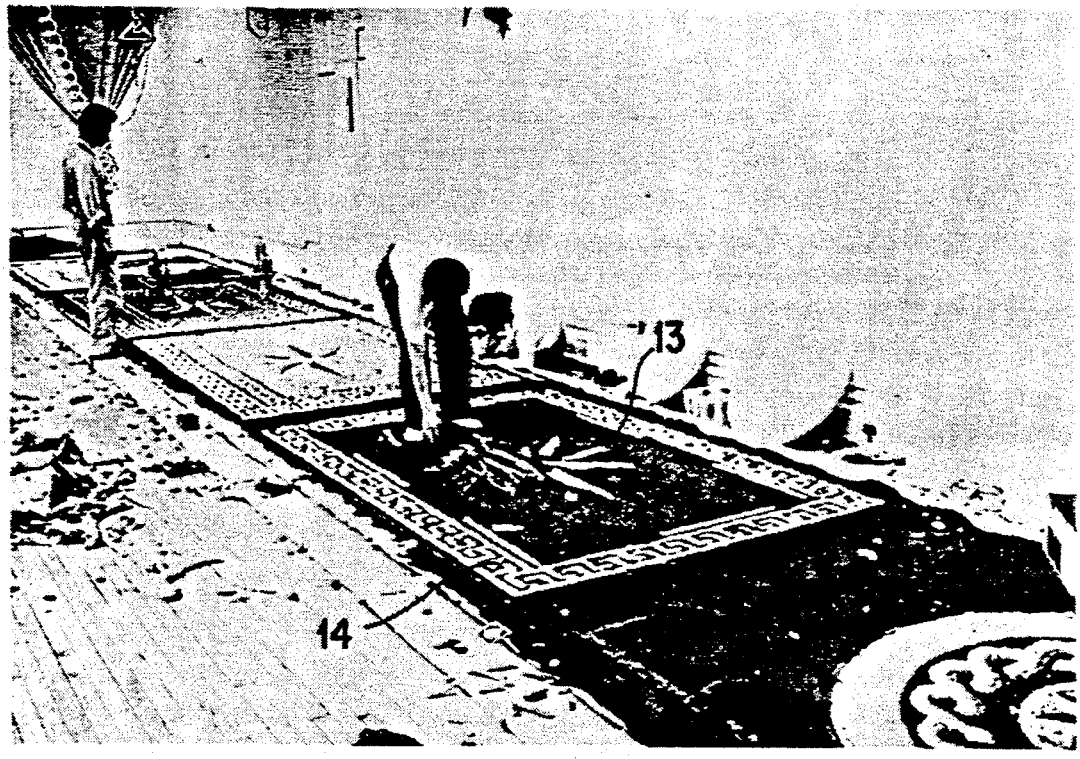
FIG. 1 is a perspective photograph showing the artists laying textile fibers on a laminar base.
Figure 2:
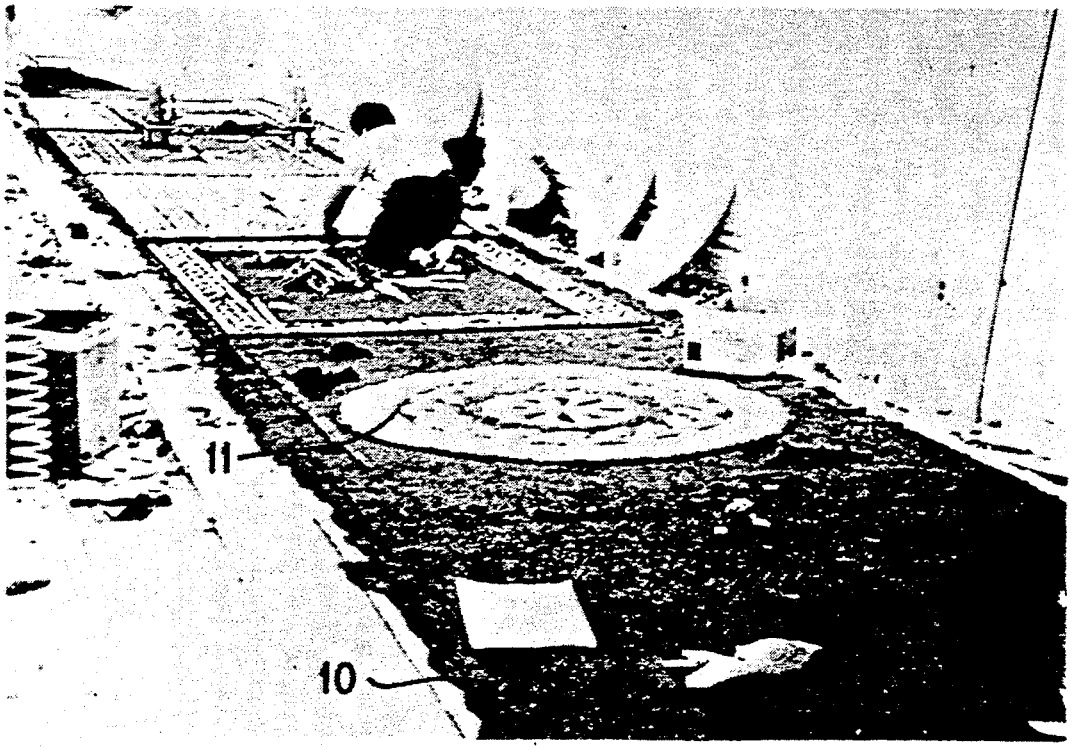
FIG. 2 illustrates how an artist can work directly with the finished product to produce a full-sized carpet.
Figure 3:
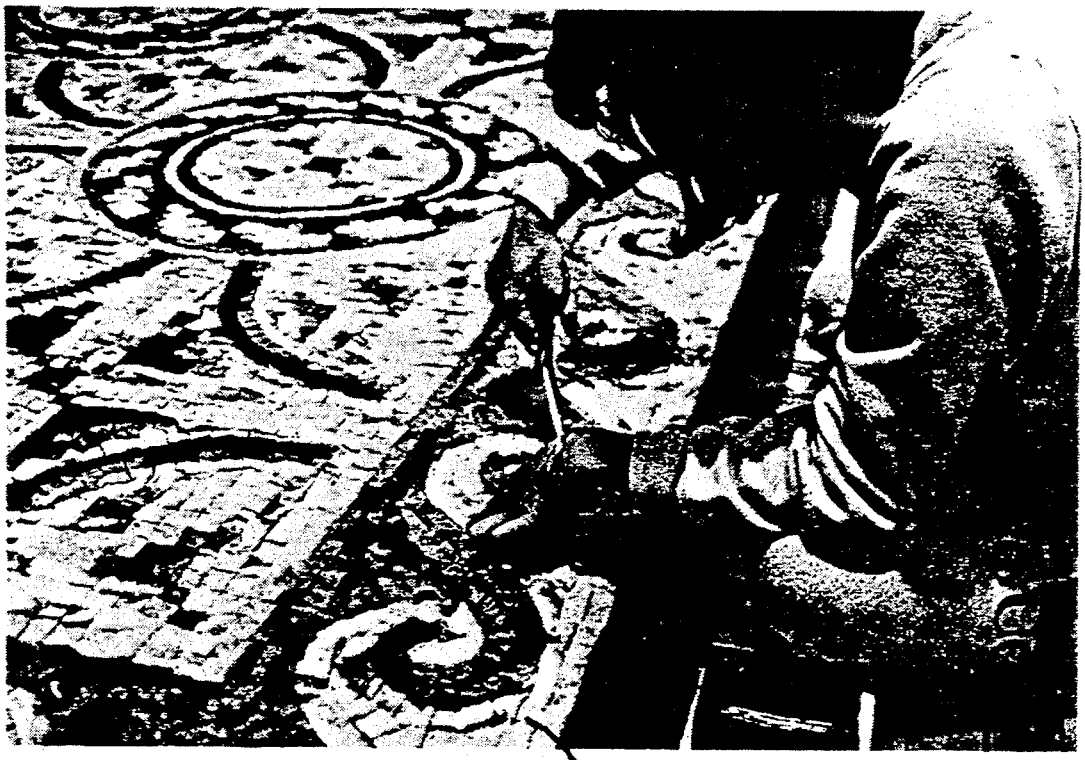
FIG. 3 shows a perspective close-up view of an artist putting pre-needled sections into place onto a large carpet- size product.
Figure 4:
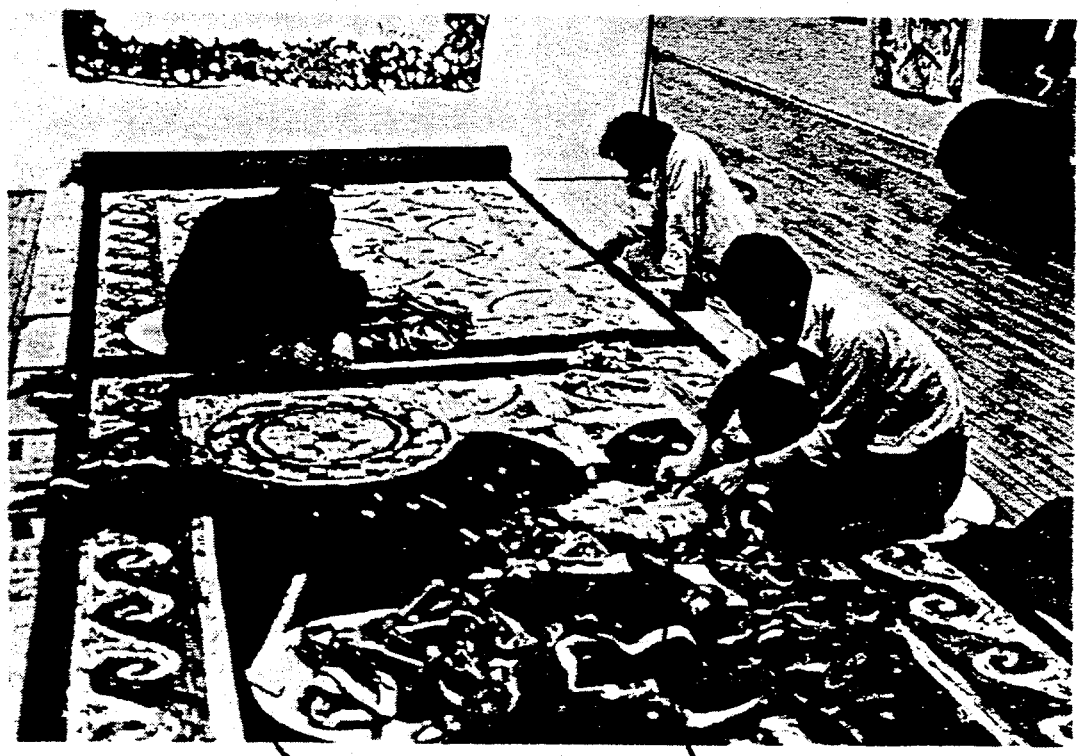
FIG. 4 is a perspective photograph showing a number of artists applying pre-assembled sections of laminated fabric elements onto the base material.

The multi-colored needle-punched fabrics are then cut into squares, strips or other desired shapes 14 and are layered on top of the base and scrim layers. This can be seen particularly in FIG. 3 where the artists are using individual needles to tack the shapes onto the base in the correct design.

The products are designed so that in the final processing, the following steps will occur:

1. The multi-layers will blend together and become one.
2. The colors will be mixed together in the needling to give the desired effect.
3. The gaps (where one color meets another) will be emphasized so that the base color will show through at those points. Some shrinkage of the top colors may occur and an outline will appear.
4. The final needling (not shown) includes a first pass of a needle machine to provide a shallow needling on one loom only. Thereafter a second pass using two looms provides deeper needling with the finished interlocking of the fibers.
5. Thereafter the product, which may be a carpet or rug or the like, is saturated in latex-based formula. Loop drying or tenter frame drying is used to cure the finish, and the finish gives durability and abrasion resistance while at the same time retaining the springiness in the final product.

To one skilled in the art, it will be understood that for various different base layers and textile fibers and pre-needled shape, one can vary the arrangement and formulation of the textile fibers, the degree of saturation, and add pressing or calendering before or after the finishing so as to complete the final product.

Additionally, after the saturation stage has taken place, it is possible, once again, to provide additional needling to give a more tufted or textile-like appearance to the product itself.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. A process for producing artistic textile or fabric materials for high-fashion carpets, rugs, tapestry, textiles, handbags, and clothing, which includes:

providing a clean, strong, colored backing base, providing a scrim material consisting of a lightly-needle-punched layer of fibers, laying the scrim onto the base and lightly needle-punching them together, providing a needle-punched fabric consisting of a plurality of teased, colored fibers, layering said fabric of colored fibers onto said base and scrim, needle-punching the assembled base, scrim and fabric so that the colors of the base and fabric will be mixed together during the needling process and the multi-layers will blend together and become a unitary structure.

2. The process of claim 1 wherein said base is a colored webbing material.

3. The process of claim 1 wherein said scrim is a polyester.

4. The process of claim 1 wherein said fibers are acrylic material.

5. The process of claim 1 wherein said base and scrim have a pattern printed thereon.

6. The process of claim 5 wherein a plurality of pieces of said fabric of colored fibers are laid upon said base and scrim according to said pattern printed on said base and scrim.

7. The process of claim 6 wherein the colored portions of the base are visible between pieces of said fabric of colored fibers.

8. The process of claim 1 wherein said base, scrim, and fabric of colored fibers, when assembled, are coated with a latex-based binding material.

* * * * *